United States Patent [19]

Romanelli et al.

[11] 4,265,612

[45] May 5, 1981

[54] INTERMITTENT PULSING GAS IGNITION SYSTEM

[75] Inventors: Pat Romanelli; Robert J. Romanelli, both of Harrington Park, N.J.; Richard W. Shutt, Central Square, N.Y.

[73] Assignee: Ram Products, Inc., Northvale, N.J.

[21] Appl. No.: 18,795

[22] Filed: Mar. 8, 1979

[51] Int. Cl.[3] ..... F23N 5/00

[52] U.S. Cl. ..... 431/66; 431/256

[58] Field of Search ..... 431/258, 256, 66, 73; 361/264–266

[56] References Cited

U.S. PATENT DOCUMENTS

| | | | |
|---|---|---|---|
| 3,597,139 | 8/1971 | Elders | 431/66 |
| 3,603,708 | 9/1971 | Good | 431/66 |
| 4,023,922 | 5/1977 | Goto | 431/256 |

FOREIGN PATENT DOCUMENTS

| | | | |
|---|---|---|---|
| 1296524 | 11/1972 | United Kingdom | 431/256 |

*Primary Examiner*—Joseph Man-Fu Moy
*Attorney, Agent, or Firm*—Edward F. Levy

[57] ABSTRACT

An intermittent pulsing ignition system for gas fired devices includes a pulser assembly having a predetermined on/off cycle, providing full wave alternating current during the on cycle and half wave current during the off cycle, to an electrical ignition element. The full wave current is sufficient to heat the ignition element to the ignition temperature of the gas and the half wave current permits the ignition element to cool during the off cycle thereby prolonging its useful life.

14 Claims, 5 Drawing Figures

INTERMITTENT PULSING GAS IGNITION SYSTEM

The present invention relates generally to gas fired devices and more particularly to a novel ignition system for gas burners.

Conventional gas fired equipment such as automatic clothes dryers, kitchen cooking ranges and the like include a pilot burner for igniting the main burner when gas is supplied to the main burner. These pilot burners operate continually to provide a constant flame consequently resulting in a waste of gas, which is burned even when a flame is not required for operation of the apparatus. The continuing and ever increasing fuel shortage makes the widespread use of such pilot burners a wasteful use of energy and therefore a serious problem.

The prior art includes devices designed to overcome the need for pilot burners. Included among such devices are electrically operated ignition elements which are heated to the ignition temperature of the gas when electrically energized. Among the disadvantages of such devices is their tendency to fail during use, due to prolonged operation at relatively high temperatures. These failures require relatively costly replacement of the device and often render the entire appliance inoperative resulting in an overall low reliability rating for appliances incorporating such ignition elements.

It is an object of the present invention to provide an electrically operated ignition system including a pulser apparatus which provides alternate periods of full wave and half wave current to an electric ignition element with the periods of half wave current permitting the ignition element to cool thereby increasing its useful life.

Another object of the present invention is to provide an intermittent pulsing gas ignition system which includes solid-state elements and which is free of moving parts which are normally subject to arcing, wear and eventual failure.

Another object of the present invention is to provide an intermittent pulsing gas ignition system which is small enough to fit into gas fired appliances which have extremely limited internal space, such as range tops, ovens and hot water heaters, thereby making possible a broad range of potential applications.

Another object of the present invention is to provide an intermittent pulsing gas ignition system having active elements which are encapsulated and completely protected against the effects of shock, vibration and humidity.

Another object of the present invention is to provide an intermittent pulsing gas ignition system which is capable of completely fail-safe operation.

Still another object of the present invention is to provide an intermittent pulsing gas ignition system comprising a relatively small number of simple components resulting in relatively low unit cost yet highly reliable operation.

In accordance with the present invention there is provided an intermittent pulsing ignition system for gas fired devices comprising an electrical ignition element connected to an electrical pulsing assembly which has a predetermined on/off cycle and which provides full wave alternating current to the ignition element during the on cycle, heating the ignition element to the ignition temperature of the gas, and providing half wave current during the off cycle, permitting the ignition element to cool thereby prolonging its useful life. An electrical switch is provided which operates to turn on the pulser assembly, responsive to the opening of a gas valve which supplies gas to a burner.

Alternative constructions of the pulser assembly provide full wave alternating current during the on cycle and zero voltage during the off cycle, or provide half wave rectified alternating current during the on cycle and zero voltage during the off cycle.

In another alternative embodiment of the invention, a pair of electrically operated normally closed solenoid gas valves are provided which operate automatically in conjunction with an electrical control circuit, which includes the pulser assembly, to ignite a gas burner responsive to the energization of a pair of thermostatic control lines.

Additional objects and advantages of the invention will become apparent during the course of the following specification when taken in connection with the accompanying drawings in which.

Figure 1:
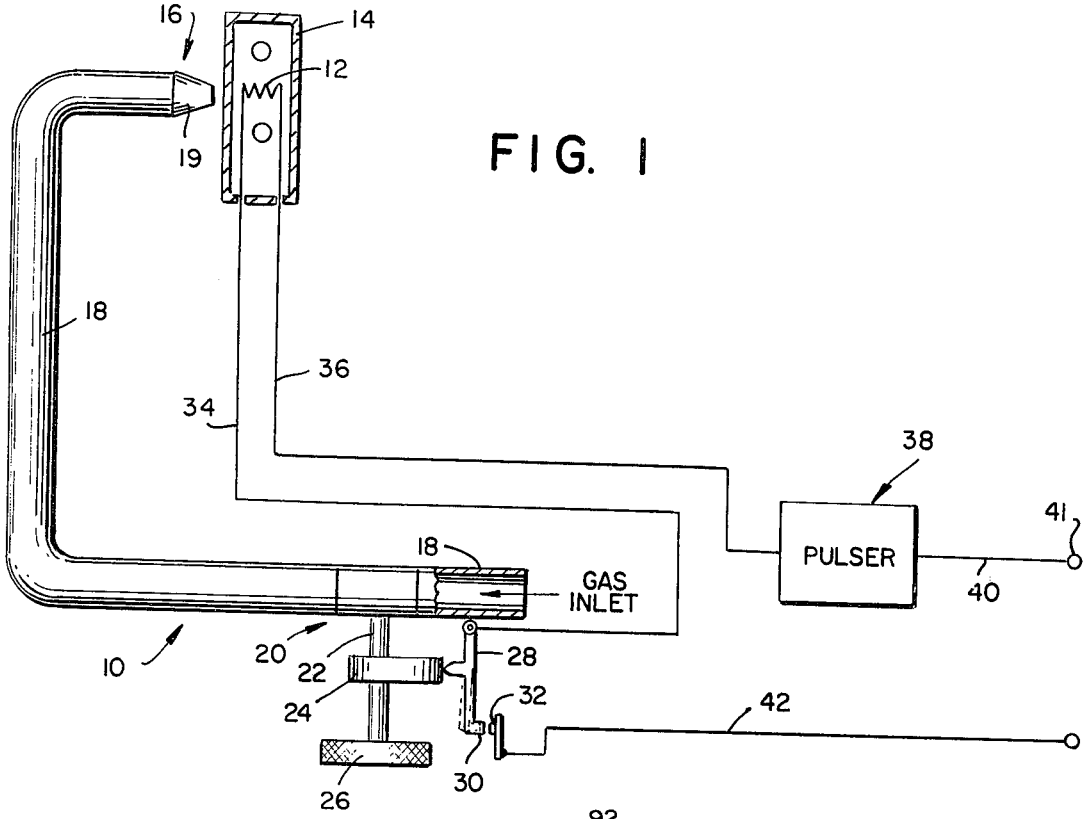
FIG. 1 is a diagrammatic view of an intermittent pulsing gas ignition system in accordance with the present invention.

Referring in detail to the drawings, and particularly to FIG. 1, there is shown an intermittent pulsing gas ignition system 10, in accordance with the present invention, comprising an electrically operated ignition element 12 which is housed in a ceramic body 14 located in close proximity to a gas burner.

The gas burner is a part of a gas fired appliance such as a clothes dryer, kitchen range or the like. The gas burner is designated generally by the reference numeral 16 and may be in the form shown for clothes dryers, in the usual circular form for cooking ranges, or in other forms. The gas burner 16 is fed by a pipe 18 leading to a source of gas under pressure through a gas control valve assembly 20. The nozzle 19 of the gas burner 16 is located close to the ignition element 12 so that the gas flowing therethrough will be ignited when the element 12 is energized to a gas ignition temperature.

The gas control valve assembly 20 includes a rotatable valve stem 22 which projects outwardly from the valve assembly 20. A cam 24 and a control knob 26 are mounted on the valve stem 22. The cam 24 bears against a pivoted switch plate 28 and closes switch contacts 30, 32 when the valve stem 22 is rotated to open the valve assembly 20, permitting gas to flow to the burner 16.

The switch plate 28 is connected to the igniter element 12 via a lead 34 and the igniter element 12 is in turn connected by lead 36, to a pulser assembly 38 which forms a novel feature of the present invention.

Figure 2:
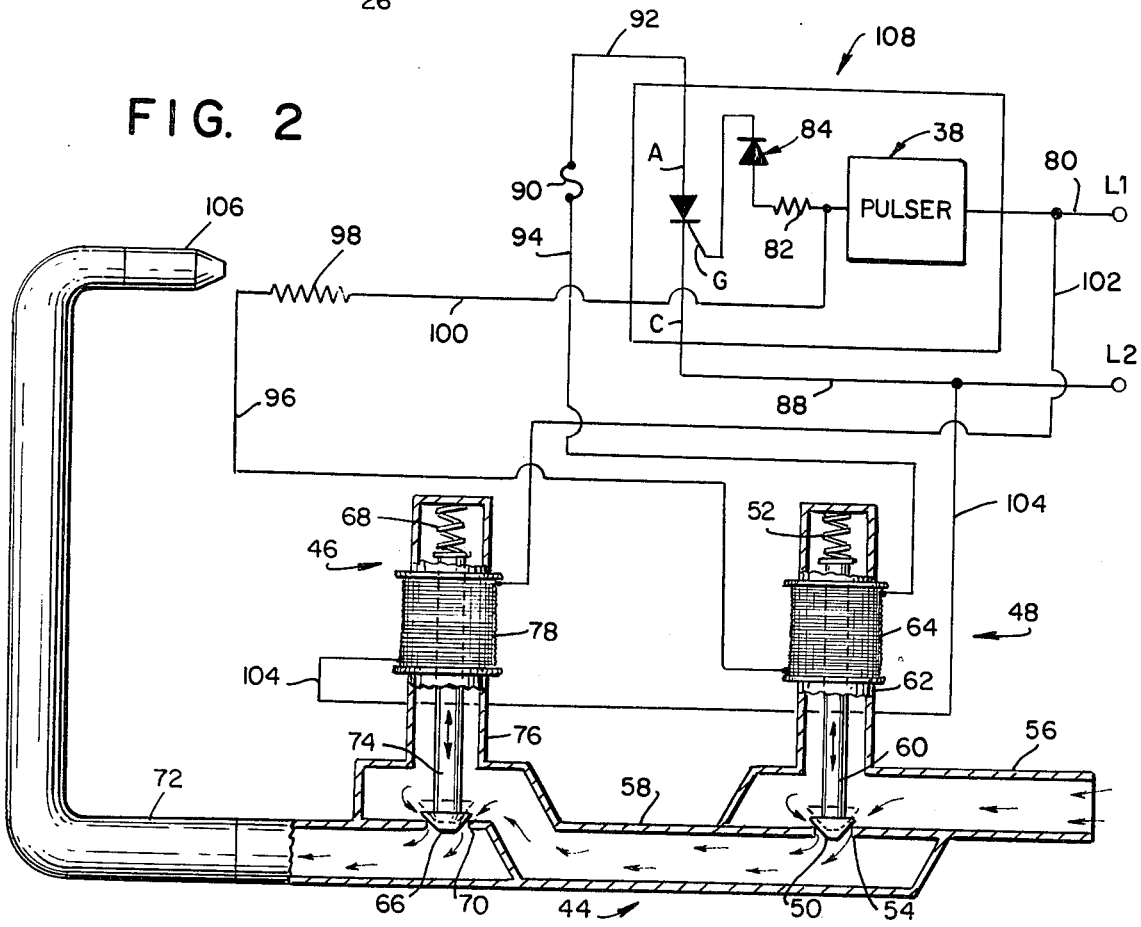
FIG. 2 is a diagrammatic view of a modified type of intermittent pulsing gas ignition system in accordance with the present invention.
Figure 3:
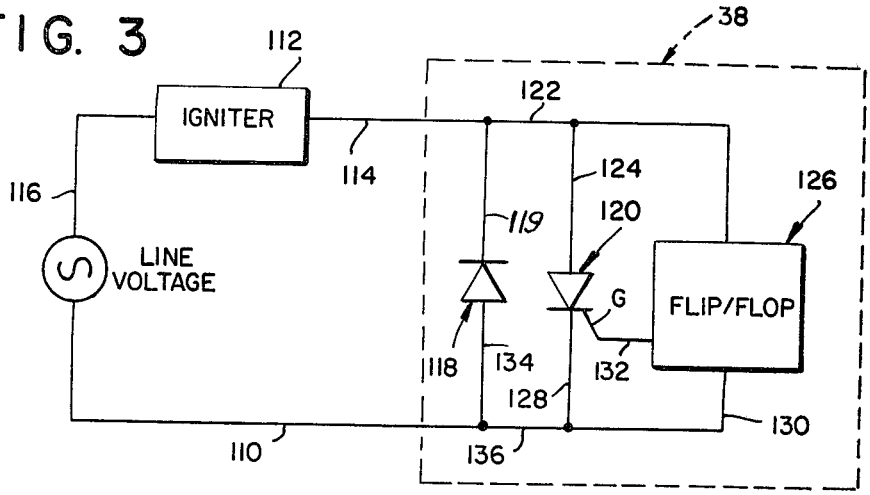
FIG. 3 is a schematic diagram of the electrical circuitry of the pulser assembly of FIGS. 1 and 2 with the pulser assembly being shown connected to the igniter and to line voltage.

The pulser assembly 38 is illustrated schematically in the form of a block in FIGS. 1 and 2. The electrical circuit of the pulser assembly 38 is shown in FIG. 3 and will be presently described in detail. Leads 40 and 42 respectively connect the pulser assembly 38 and the switch contact 32 to the terminals 41 and 43 of a source of alternating current electrical power.

The pulser assembly 38, in general, comprises a solid state on/off recycling control having a predetermined on/off ratio, or duty cycle. During the off period the pulser assembly 38 delivers continuous half-wave rectified 120 volt alternating current to the igniter element 12. During the on period the pulser assembly 38 delivers full-wave 120 volt alternating current with a current capability in the order of one ampere, steady state, with inrush current in the order of 10 amperes. The off period is in the order of three-quarters ($\frac{3}{4}$) of a second to one (1) second in duration and the on period is in the order of one tenth (0.1) second to one-quarter ($\frac{1}{4}$) second in duration. The pulser assembly 38 continues to operate as long as the switch contacts 30, 32 remain closed, delivering current to the igniter 12 according to the above on/off cycle. The current delivered to the igniter 12 during the on period is sufficient to heat the igniter 12 to the ignition temperature of the gas. During the off period the igniter element 12 cools thereby increasing its useful life.

The intermittent cycle of the pulser assembly 38 insures the ignition of the gas whenever the gas control valve 20 is open. In the event of a flameout, the igniter 12 relights the gas burner 16. When the gas control valve 20 is closed, the cam 24 opens the switch contacts 30,32 resulting in a saving of gas as compared with conventional devices which incorporate a constantly burning pilot and a saving of electricity as compared with devices having a constantly energized igniter.

The ignition element 12 may be a bar of silicon carbide material which is heated to the ignition temperature of the gas, upon being electrically energized, or it may be any other suitable resistance material in plate or wire form.

The pulser assembly 38 may be encapsulated thereby providing protection against the effects of shock, vibration and humidity.

An alternative embodiment of the invention is shown in FIG. 2 and incorporates a gas control valve assembly 44 which is solenoid operated, together with the pulser assembly 38 previously described to form an automatic system 108.

The gas control valve assembly 44 includes a main solenoid valve 46 and a safety solenoid valve 48. The safety solenoid valve 48 has a valve head 50 which is normally biased in a downward direction by a spring 52 so as to be seated within a valve seat 54, connecting the gas inlet pipe 56 and the conduit 58, and thus normally blocks the flow of gas from the inlet pipe 56 to the conduit 58. The valve head 50 is carried by a valve stem 60 which is made of a magnetically-permeable material and is slidably mounted within a solenoid core 62 in such a manner that the valve stem 60 serves as an armature of the solenoid valve 48. The safety solenoid valve 48 also includes an actuating coil 64, surrounding the core 62 and adapted to lift the valve stem 60 when electrically energized.

The main solenoid valve 46 is of similar construction, having a valve head 66 which is normally biased by a spring 68 to a seated condition in a valve seat 70 connecting the conduit 58 with the burner pipe 72, and thus normally blocking the flow of gas from the conduit 58 to the burner pipe 72. The valve head 66 is carried by a valve stem 74 slidably mounted within the solenoid core 76 and serving as the armature of the main solenoid valve 46. The core 76 is associated with an actuating coil 78 which, when energized, lifts the valve stem 74 and thus raises the valve head 66 from its normal seated position within the valve seat 70.

Figure 4:
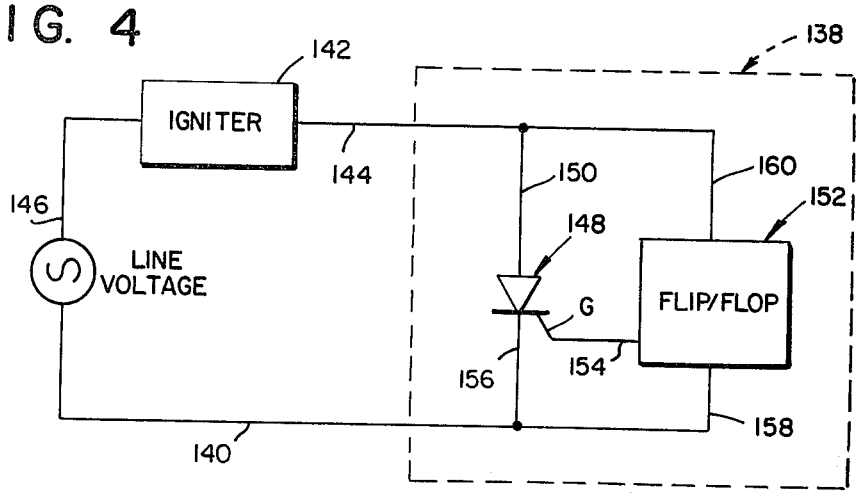
FIG. 4 is a schematic diagram of an alternative construction of the pulser circuit of FIG. 3.

The input to the pulser assembly 38 is connected to the thermostat line designated as $L_1$ in FIG. 4 via a lead 80. The output of the pulser assembly 38 is connected in series, in order stated, to a resistor 82, a diode 84 and the gate, designated by the letter G, of a gate controlled rectifier (SCR) 86. The cathode of the SCR 86, designated by the letter C, is connected to the thermostat line $L_2$ via a lead 88. The anode of the SCR 86, designated by the letter A, is connected to a fuse 90 via a lead 92, and the fuse 90 is connected, in turn, to the actuating coil 64 of the normally closed safety solenoid valve 48 via a lead 94. The actuating coil 64 is connected via a lead 96 to an igniter 98 which may be of the type previously described. The igniter 98 is connected to the output of the pulser assembly 38 by means of a lead 100. The actuating coil 78 of the main solenoid valve 46 is connected to the thermostat line $L_1$ and $L_2$ via leads 102 and 104, respectively.

During operation, current flows through the lead 80 to the pulser assembly 38 which, as has been previously described, provides alternating periods of half wave and full wave output current. The output of the pulser assembly triggers the SCR 86 via the resistor 82 and the diode 84. When the SCR 86 is triggered, current can flow from pulser 38 through the igniter 98 via lead 100 and through the actuating coil 64 via lead 96, through the fuse 90, via lead 94, through the SCR 86 and out through the thermostat line $L_2$ via lead 88. The actuating coil 64, being energized, lifts the valve stem 60 thereby unseating the valve head 50 from the valve seat 54, permitting gas to flow from the pipe 56 to the conduit 58. The actuating coil 78 of the main gas valve 46 is energized via leads 102, 104 and lifts the valve stem 74 thereby unseating the valve head 66 from the valve seat 70, permitting gas to flow through the burner pipe 72 to the burner 106 whereupon it is ignited by the igniter 98.

During the on period of the thermostat, lines $L_1$ and $L_2$ are energized and the pulser assembly 38 delivers pulsed power to the igniter 98. If for any reason the igniter 98 is broken, the current to the actuating coil 64 is interrupted and the safety valve 48 closes, interrupting the flow of gas and shutting the system 108 down. If any component of the SCR circuit is shorted, the fuse 90, which is rated at the maximum current rating of the circuit, will open and also shut down the system 108. A failure of the pulser assembly 38 or any component in the SCR circuit in the open condition will interrupt the current to the actuating coil 64 and will similarly result in the system 108 being shut down.

The combination of the main and safety gas valves 46, 48, and the SCR circuit with the pulser assembly 38 results in an automatic ignition system 108 which combines long and reliable igniter performance with an extremely high degree of inherent safety.

The embodiment of the invention shown in FIG. 2 is particularly adapted for use in automatic appliances in which the burner ignition control is automatically effected by a thermostat or timer mechanism. The embodiment of the invention shown in FIG. 1 is particularly adapted for installation in a gas cooking range in which the opening of the gas valve is performed manually.

The circuit components of the pulser assembly 38 of FIGS. 1 and 2 are shown schematically in FIG. 3. The components of the pulser assembly 38 are contained within the broken line which corresponds to the rectangular block in FIGS. 1 and 2. The input to the pulser assembly 38 is shown in FIG. 3 connected to a source of electrical power via the lead 110 and the output of the pulser assembly 38 is shown connected to the igniter 112 via the lead 114. The igniter 112 in turn is connected to the source of electrical power via the lead 116. The connection of the pulser assembly 38 to the source of electrical power and to the igniter 112 is generally similar to the connections shown in FIGS. 1 and 2 and has been repeated in FIG. 3 for the purpose of clarity. The input of the pulser assembly 38 is connected to the anode of a diode 118 via the lead 119. The cathode of the diode 118 is connected to the anode of a gate controlled rectifier (SCR) 120 via the leads 122, 124 and the cathode of the SCR 120 is connected to a flip flop circuit 126 via leads 128 and 130. The gate of the SCR 120 is designated by the letter G and is connected to the flip flop circuit 126 via the lead 132, and the cathode of the SCR 120 is connected to the anode of the diode 118 via the leads 128, 136 and 134 which are also connected to the lead 130.

During the operation of the pulser assembly 38 full wave alternating current is imposed on the igniter 112 during the "on" period of the pulser assembly 38 and half wave rectified alternating current is imposed on the igniter 112 during the "off" period of the pulser assembly 38. It will be apparent that when the flip flop circuit 126 energizes the gate G of SCR 120, the latter acts as a diode to allow current to flow in one direction from lead 122 to lead 136. In the positive half-cycle of the alternating current, the current will flow from the power source through lead 116, through igniter 112, leads 114, 122 and 124, through SCR 120 and through leads 128, 136 and 110 to the power source. In the negative half-cycle, current will flow in the opposite direction through diode 118, from lead 136 to lead 122. Thus, full-wave current will flow through igniter 112. When the flip flop circuit is in the "off" mode, it applies no energizing voltage to gate G, so that SCR 120 acts as an open circuit between lines 122 and 136, whereby line current will flow through diode 118 in one direction only, thereby impressing a half-wave current upon igniter 112.

An alternative circuit configuration for the pulser assembly is shown in FIG. 4. The components of the alternative pulser assembly 138 are shown within the broken line. In a manner similar to that described above, the input of the pulser assembly 138 is shown connected to a source of electrical power via the lead 140, and the output of the pulser assembly 138 is shown connected to the igniter 142 via the lead 144. The igniter 142 is connected to the source of electrical power via the lead 146. The input of the pulser assembly 138 is connected to the cathode of a gate controlled rectifier (SCR) 148 via the lead 150, and the anode of the (SCR) 148 is connected to a flip flop circuit 152 via the leads 156, 158. The gate of the (SCR) 148 is designated by the letter G and is connected to the flip flop circuit 152 via the lead 154. The flip flop circuit 152 is also connected to the anode of the SCR 148 via the leads 150 and 160. The anode of the SCR is connected to the igniter 142 via the leads 144 and 150.

During operation of the pulser assembly 138, shown in FIG. 4, half-wave rectified alternating current is imposed on the igniter during the "on" period of the pulser assembly and zero voltage is imposed on the igniter 142 during the "off" period. When the flip flop circuit 152 energizes gate G of SCR 120, the latter acts as a diode to allow current to flow in one direction only from leads 144 to 140, thereby impressing a half-wave current on igniter 142. During the "off" mode, when gate G is not energized, the SCR 120 acts as an open circuit, thereby preventing any current flow through igniter 142.

Figure 5:
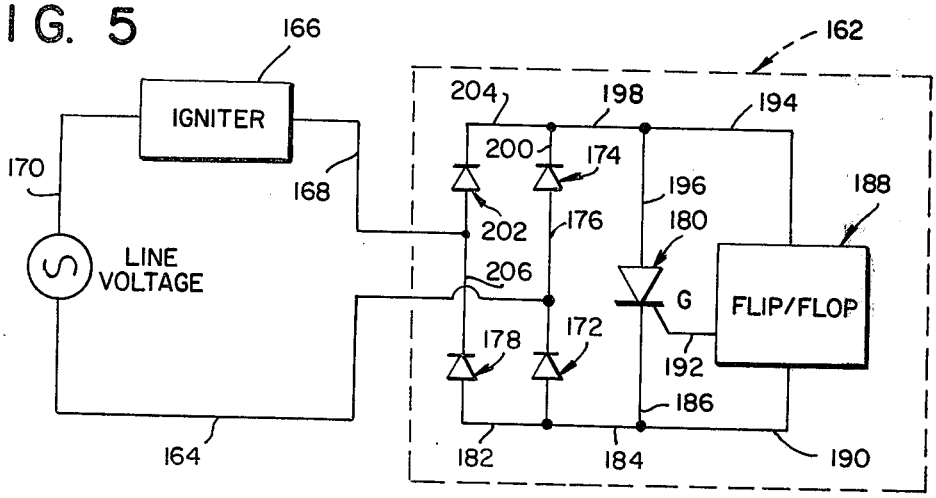
FIG. 5 is a schematic diagram of another alternative construction of the pulser circuit of FIG. 3.

Another alternative circuit configuration for the pulser assembly is shown in FIG. 5. The components of the second alternative pulser assembly 162 are shown within the broken line. In a manner similar to that described above with reference to FIGS. 3 and 4, the input of the pulser assembly 162 is shown connected to a source of electrical power via the lead 164 and the output of the pulser assembly 162 is connected to the igniter 166 via the lead 168. The igniter 166 is connected in turn to the source of electrical power via the lead 170. The input of the pulser assembly 162 is connected via lead 164 to the cathode of a diode 172, and to the anode of a diode 174 via lead 176. The anode of a diode 178 and the anode of the diode 172 are connected to the cathode of a gate controlled rectifier (SCR) 180 via leads 182, 184 and 186. The cathode of the SCR 180 is also connected to a flip flop circuit 188 via the lead 190. The flip flop circuit 188 is also connected by lead 192 to the gate of the SCR 180, which is designated by the letter G, and is connected to the anode of the SCR 180 via the leads 194 and 196. The anode of the SCR 180 is also connected to the cathode of the diode 174 via the leads 196, 198 and 200 and the cathode of the diode 174 is connected to the anode of the diode 202 via the leads 200 and 204. The lead 206 connects the anode of the diode 202 and the cathode of the diode 178 and is also connected to the lead 168.

The diodes 172, 174, 178 and 202 form a bridge and during operation of the pulser assembly 162, shown in FIG. 5, full wave alternating current is imposed on the igniter 166 during the "on" period of the pulser assembly 162 and zero voltage is imposed on the igniter 166 during the "off" period of the pulser assembly 162.

Specifically, when the flip flop circuit 188 energizes gate G of SCR 180, the latter supplies full wave current to the igniter 166. In the positive half cycle of the alternating current when the lead 170 from the power source to the igniter 166 is positive, current flows through lead 168, diode 202, leads 204 198 and 196, SCR 180, lines 186 and 184, diode 172 and line 164 to the power source. In the negative half cycle, when lead 170 is negative, current flows through the lead 164, lead 176, diode 174, leads 200, 198 and 196, SCR 180, leads 186, 184 and 182, diode 178, leads 206 and 168, igniter 166, and leads 170 to the power source. Thus full wave current is supplied to igniter 166.

When the flip flop 126 is in the "off" mode and applies no energizing voltage to gate G, SCR 180 acts as an open circuit between leads 198 and 184, and the diodes 172, 174, 178 and 202 block any flow of current through the igniter 166 in either half cycle of the alternating current.

It is to be understood that the embodiments of the pulser assembly shown in FIGS. 3, 4 and 5 are disclosed by way of example, each embodiment being capable of extending the life of the igniter by providing an on/off recycling of power thereto. Other types of pulser controls capable of performing the same function may be employed in the ignition system of the present invention, such as thermal flashers, electronic timer flashers with relay output, motor driven repeat cycle timer flashers, solid state repeat cycle timers, etc.

While preferred embodiments of the invention have been shown and described herein, it is obvious that numerous omissions, changes and additions may be made in such embodiments without departing from the spirit and scope of the invention.

What is claimed is:

1. A pulsing ignition system for gas fired devices having a source of electrical power, a burner provided with an outlet, and a fuel valve for controlling the flow of gas to said burner; said system comprising an electrical ignition element of resistance material adaptable for connection to said source of electrical power, and located in proximity to said burner outlet for igniting gas flowing thereto when said ignition element is energized and brought to a gas ignition temperature, electrical pulse generating means in circuit with said electrical ignition element, said pulse generating means having a predetermined on/off cycle and being adapted to provide energizing current to said electrical ignition element during said on cycle, of a value sufficient to energize and heat said electrical ignition element to a gas ignition temperature, and current of reduced value during said off cycle thereby permitting said electrical ignition element to cool during said off cycle, said pulse generating means including a gate controlled rectifier, and a flip flop circuit having its output connected to the gate of said gate controlled rectifier, and electrical control means connecting said fuel valve and said electrical pulse generating means for operation of said electrical pulse generating means when said fuel valve is open.

2. A system according to claim 1 in which said on cycle of said electrical pulse generating means ranges from one-tenth to one-quarter second in duration and said off cycle ranges from three-quarters to one second in duration.

3. A system according to claim 1 in which said on cycle of said electrical pulse generating means has a preferred duration in the order of one-tenth second and said off cycle has a preferred duration in the order of one second.

4. A system according to claim 1 in which said electrical pulse generating means comprises a solid state electronic assembly.

5. A system according to claim 1 in which said electrical pulse generating means is connected in series with said ignition element and said electrical power source.

6. A system according to claim 5 in which said electrical pulse generating means is adapted to provide full wave alternating current during said on cycle and half wave alternating current during said off cycle.

7. A system according to claim 5 in which said electrical pulse generating means is adapted to provide half-wave alternating current during said on cycle and zero voltage during said off cycle.

8. A system according to claim 5 in which said electrical pulse generating means is adapted to provide full wave alternating current during said on cycle and zero voltage during said off cycle.

9. A system according to claim 6 in which said electrical pulse generating means comprises a diode and a gate controlled rectifier in parallel arrangement and poled in opposite directions, and a flip flop circuit having its output connected to the gate of said gate controlled rectifier.

10. A system according to claim 7 in which said electrical pulse generating means comprises a gate controlled rectifier connected in series with said ignition element and said electrical power source, and a flip flop circuit having its output connected to the gate of said gate controlled rectifier.

11. A system according to claim 8 in which said electrical pulse generating means comprises a full wave rectification bridge circuit, a gate controlled rectifier in parallel with the output of said bridge circuit, and a flip flop circuit having its output connected to the gate of said gate controlled rectifier.

12. A system according to claim 1 in which said electrical control means comprises a cam mounted on said fuel valve, electrical switch means disposed proximate said cam for operation by said cam, and electrical connection means connecting said pulse generating means to said source of electrical power through said switch means.

13. A system according to claim 1 in which said fuel valve comprises a first and a second electromagnetic fuel valve, a solenoid for opening said valve, said first fuel valve being disposed to admit fuel, when in the open state, to said second fuel valve, said second fuel valve being disposed to admit fuel, when in the open state, to said burner, and electrical circuit means connecting the solenoid of said second fuel valve to said source of electrical power and connecting said solenoid of said first fuel valve to said electrical pulse generating means for operation of said first fuel valve in response to operation of said pulse generating means and for operation of said second fuel valve in response to activation of said source of electrical power.

14. A system according to claim 12, in which said electrical circuit means connecting said pulse generating means and the solenoid of said first fuel valve comprises a gate controlled rectifier and circuit connection means operable in response to operation of said pulse generating means to energize said gate controlled rectifier to a conducting state, thereby permitting current to flow to said solenoid of said first fuel valve.

* * * * *